US007287402B2

(12) United States Patent
Ratfisch

(10) Patent No.: US 7,287,402 B2
(45) Date of Patent: Oct. 30, 2007

(54) LAUNDRY DRUM FOR A DRUM-TYPE WASHING MACHINE

(75) Inventor: Uwe Ratfisch, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 619 days.

(21) Appl. No.: 10/738,655

(22) Filed: Dec. 17, 2003

(65) Prior Publication Data

US 2004/0129036 A1 Jul. 8, 2004

(30) Foreign Application Priority Data

Dec. 17, 2002 (DE) ..... 102 59 059

(51) Int. Cl.
*D06F 21/00* (2006.01)

(52) U.S. Cl. ..... 68/142; 68/24; 68/3 R

(58) Field of Classification Search ..... 68/24, 68/139, 142, 3 R
See application file for complete search history.

(56) References Cited

U.S. PATENT DOCUMENTS 6,401,363 B1 * 6/2002 Miramondi ..... 34/602

FOREIGN PATENT DOCUMENTS

GB 1161219 * 8/1966

* cited by examiner

*Primary Examiner*—Michael Barr
*Assistant Examiner*—Jason Heckert
(74) *Attorney, Agent, or Firm*—Russell W. Warnock; Craig J. Loest; James E. Howard

(57) ABSTRACT

Paddles are fastened on an inside of a drum casing by fastening elements. The paddles contain a hollow body, which is open in the direction of the drum casing and has a cross-sectional surface area similar to a triangle, and stiffening structures on the insides of its flanks. For secure and permanently stable fastening, in the region of at least some of the structures, strip-shaped installation parts are connected in a form-fitting manner, by way of a section located essentially parallel to the surface of the drum casing, to the inside of the flanks. Moreover, the sections have at least two fastening elements by which the paddle is fastened on the drum casing.

11 Claims, 3 Drawing Sheets

LAUNDRY DRUM FOR A DRUM-TYPE WASHING MACHINE

BACKGROUND OF THE INVENTION

Field of the Invention

The invention is based on a laundry drum for a drum-type washing machine. The laundry drum has at least one paddle which is fastened on the inside of the drum casing by fastening elements and contains a hollow body, which is open in the direction of the drum casing and has a cross-sectional surface area similar to a triangle. The paddle additionally has stiffening structures disposed on the inside of its flanks.

Such a washing drum is known, for example, from British Patent Specification GB 1,161,219. In the latter, the paddles, which are formed from plastic, are fastened on the drum casing by way of latching components in that the latching components, when the paddles are inserted, are positioned in the through-passages of a pattern of holes which is congruent with the configuration of the latching components, and are then displaced laterally until the latching components pass beneath sheet-metal noses of the through-passages and are arrested there. In addition, the paddles are then also connected to the drum casing by screws that pass into the drum casing from the outside through paddle parts, in order that the paddles cannot move out of the arresting position.

Such paddles are indeed fastened securely on the drum casing. However, since the drum and the paddles are subjected to very high forces when the laundry drum spins, in particular at high spinning speeds (above 1,500 rpm), there is a risk of elastic deformation of the casing sheet and of the paddles if the latter is formed of plastic, which is standard nowadays. Gaps may be produced here between the paddle edges and the casing sheet of the drum, it being possible for items of laundry to pass into the gaps and to get trapped and damaged following completion of the spinning process—following return deformation of all the components involved.

Moreover, the task of fastening plastic parts directly on comparatively non-elastic underlying surfaces gives rise to problems in principle. This is because it is known that plastic progressively deforms plastically when subjected to forces over a long period of time. In the case of the known paddles, this type of fastening is not permanent. Over a relatively long period of time, the interconnected points of contact gain so much play that such paddles rattle during each movement.

SUMMARY OF THE INVENTION

It is accordingly an object of the invention to provide a laundry drum for a drum-type washing machine that overcomes the above-mentioned disadvantages of the prior art devices of this general type, in which the paddles are fastened in a secure and stable manner, do not form any harmful gaps between them and the drum casing during high-speed spinning due to deformation of the drum and the paddles themselves and, in addition, are not subjected, over a long period of time, to progressive deformation resulting in the connections being released, and in rattling.

With the foregoing and other objects in view there is provided, in accordance with the invention, a laundry drum for a drum-type washing machine. The laundry drum contains a drum casing having an outer surface, and at least one paddle fastened on an inside of the drum casing and having a hollow body being open in a direction of the drum casing and a cross-sectional surface area similar to a triangle. The paddle further contains flanks, stiffening structures disposed on insides of the flanks, and strip-shaped installation parts disposed in a region of at least some of the stiffening structures. The strip-shaped installation parts each have a section disposed substantially parallel to the outer surface of the drum casing and connected in a form-fitting manner with the insides of the flanks. The section has at least two fastening elements for fastening the paddle to the drum casing.

The object is achieved according to the invention, in that, in the region of at least some of the structures, strip-shaped installation parts are connected in a form-fitting manner, by way of a section located substantially parallel to the surface of the drum casing, to the inside of the flanks, and the sections have at least two fastening elements by which the paddle is fastened on the drum casing.

This indirect connection between the paddles and the drum casing provides the connecting device (strip-shaped installation parts) with a certain amount of elasticity, the connecting device constantly following the progressive deformation elastically, so that the form-fitting connection is never relinquished. This gives a stable and secure connection between the paddles and the drum casing on a permanent basis, and the formation of gaps between the paddle and the drum casing, in which for example items of laundry could get stuck, is avoided.

The necessary elasticity is illustrated particularly advantageously in that the strip-shaped installation part, at its ends, has regions which are angled in the direction of the interior of the paddle and terminate in lug-like end sections, by which the strip-shaped installation part grips beneath undercuts of the associated structures. This is because two bending zones are produced in the strip-shaped installation part, and the bending zones, as resilient elements, ensure the necessary elasticity.

If, according to a further advantageous configuration of the invention, the strip-shape installation part is flexurally rigid in the region between the fastening elements, it is possible for one of the paddles to be installed over the connecting seam of the drum casing such that the fastening elements of the strip-shaped installation part are located on both sides of the connecting seam and the installation part serves as a local reinforcement of the drum casing by bridging in a stabilizing manner the drum-casing weak point which is caused by the connecting seam. The rigidity of the drum casing is advantageously increased there and also at the locations where the rest of the paddles are installed.

In a development of the invention that differs from the latter, but is likewise advantageous, the regions around the fastening elements of the strip-shaped installation part are of an elastic construction. The task of fitting the installation parts on the paddles is thus easier and more secure. It is thus possible for the elastically configured installation parts, prior to the installation of the paddles, to be guided beneath the undercuts from above the open sides of the paddles, with the elastic parts being bent together in the process.

In a particularly advantageous manner, the fastening elements on the strip-shaped installation parts are threaded holes and those for providing the connection between the drum casing and the paddles are screws. If the task of stiffening the drum-casing connecting seam and possibly also the rest of the drum-casing surfaces is of prime importance, the screw connection is the most secure fastening method.

An approximately equivalent variant of the invention here should be one in which the fastening elements on the strip-shaped installation parts are holes and those for providing the connection between the drum casing and the paddles are rivets. The fastening method is possibly preferable on account of the cost advantages in relation to screw connection.

It may be even more cost-effective in this respect if, according to a further development of the invention, the fastening elements on the strip-shaped installation parts are integrally formed rivets which, for connecting the paddle to the drum casing, pass through holes in the drum casing.

If more weight is placed on cost advantages than on the best securing values of the connection between the paddles and the drum casing, the fastening elements on the strip-shaped installation parts may be integrally formed lugs which, in order to connect the paddle to the drum casing, pass through slots in the drum casing and are bent over onto the outer surface of the drum casing.

It is particularly advantageous in all cases if the strip-shaped installation parts are formed from sheet metal.

Other features which are considered as characteristic for the invention are set forth in the appended claims.

Although the invention is illustrated and described herein as embodied in a laundry drum for a drum-type washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
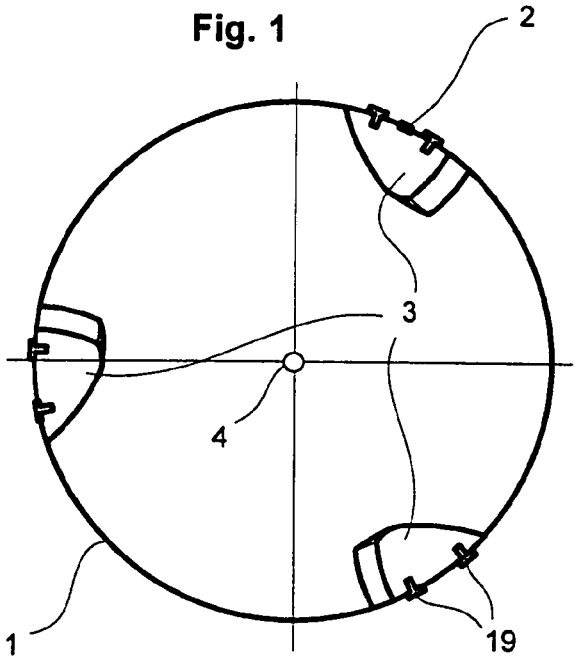
FIG. 1 is a diagrammatic, side-elevational view of a drum casing fitted with three paddles.

Referring now to the figures of the drawing in detail and first, particularly, to FIG. 1 thereof, there is shown a rolled drum casing 1 which is held together at a connecting seam 2 and is fitted with three uniformly distributed paddles 3 on its inside. The shape of the paddles 3 is not of any great significance for the invention, although a conventional shape is one that is at least more or less similar to a triangle (symmetrical or asymmetrical) in cross section. In the present case, the paddles 3 are even slightly helical, with the result that their longitudinal extent is not located parallel to a center axis 4 of the drum casing 1.

Figure 2:
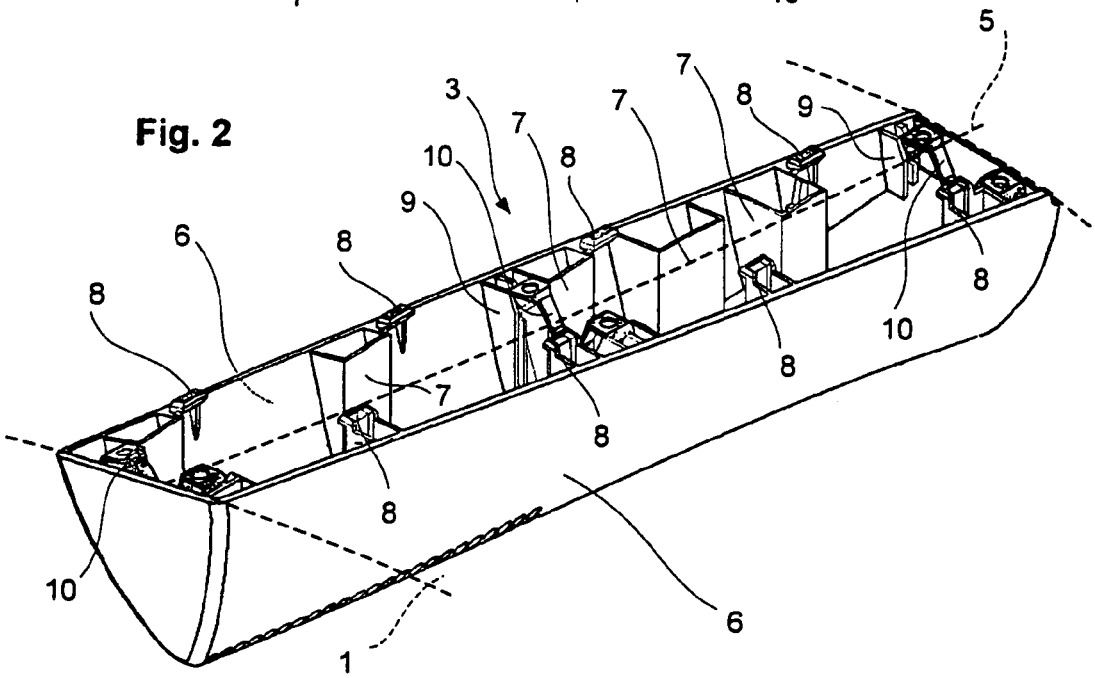
FIG. 2 is a diagrammatic, perspective view from an open side of an individual paddle, fitted with strip-shaped installation parts.

By way of the individual paddle 3 illustrated on a larger scale in FIG. 2, the configuration of the paddle 3 on the inside of the drum casing 1 and the configuration thereof are more clearly evident. In FIG. 2, part of the drum casing 1 is indicated by dashed lines. Also indicated is an imaginary line 5, which could indicate the position of the connecting seam 2 beneath the paddle 3 and is located parallel to the center axis 4 of the drum.

Stiffening structures 7 and 9 are fitted in an interior of the paddle 3, on flanks 6 of the latter, and serve in part, on the one hand, for covering the non-illustrated fastening through-passages in the drum casing 1 for latching components 8 in the installed position of the paddle 3. On the other hand, the structures 7 and 9 serve for stiffening the flanks 6 such that they do not collapse when the drum casing 1 is subjected to extreme deformation under pronounced loading during high-speed spinning.

Some of the stiffening structures 9, moreover, serve for retaining strip-shaped installation parts 10, by which the paddles 3 are fastened tightly against the drum casing 1 by way of fixed connections. More specific details in this respect can be gathered from FIGS. 3 and 4.

Figure 3:
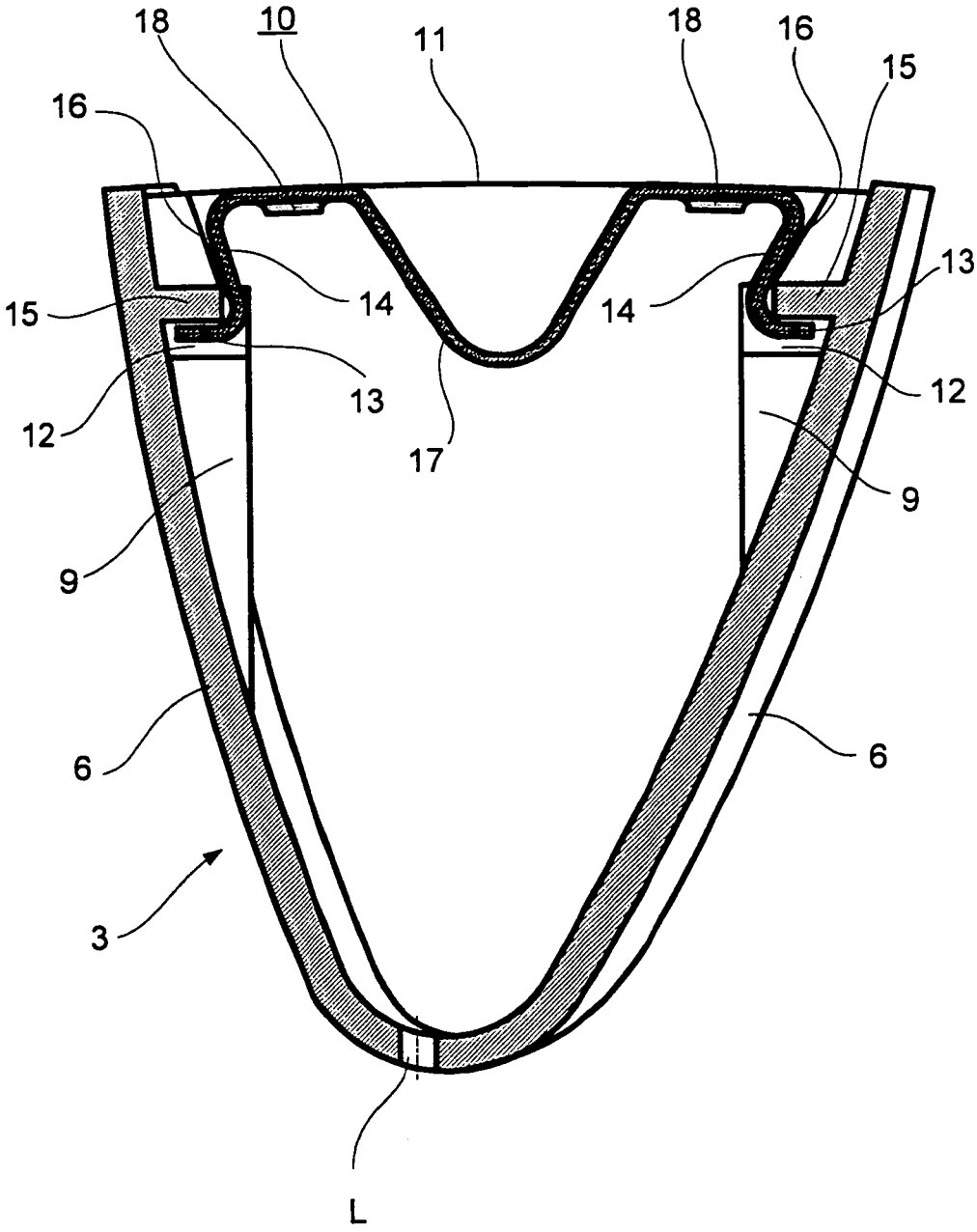
FIG. 3 is a sectional view through the paddle according to the invention in a direction transverse to a longitudinal extent thereof.

The stiffening structures 9 in FIG. 3, in the vicinity of an open base side 11 of the paddle 3, by which the latter is connected to the inside of the drum casing 1, is formed in each case with an undercut 12 in each flank 6 such that a lug-like end section 13 of an angled end 14 of the strip-shaped installation part 10, in this case configured as a resilient sheet-metal strip, can engage in the undercut 12. The angled end 14, for this purpose, is of a resilient configuration in order that the sheet-metal strip 10, during insertion, can be moved past a top section 15 of the stiffening structure 9. In this case, the outermost edge of the lug-like end section 13 slides along an oblique edge 16 of the top section 15 of the stiffening structure 9 and, finally, falls into the undercut 12. In order to facilitate the introduction of the sheet-metal strip 10, it is also the case that its central section 17, which—apart from the arcuate curvature in the downward direction—is located essentially parallel to the drum casing 1, is of a resilient configuration.

Figure 4:
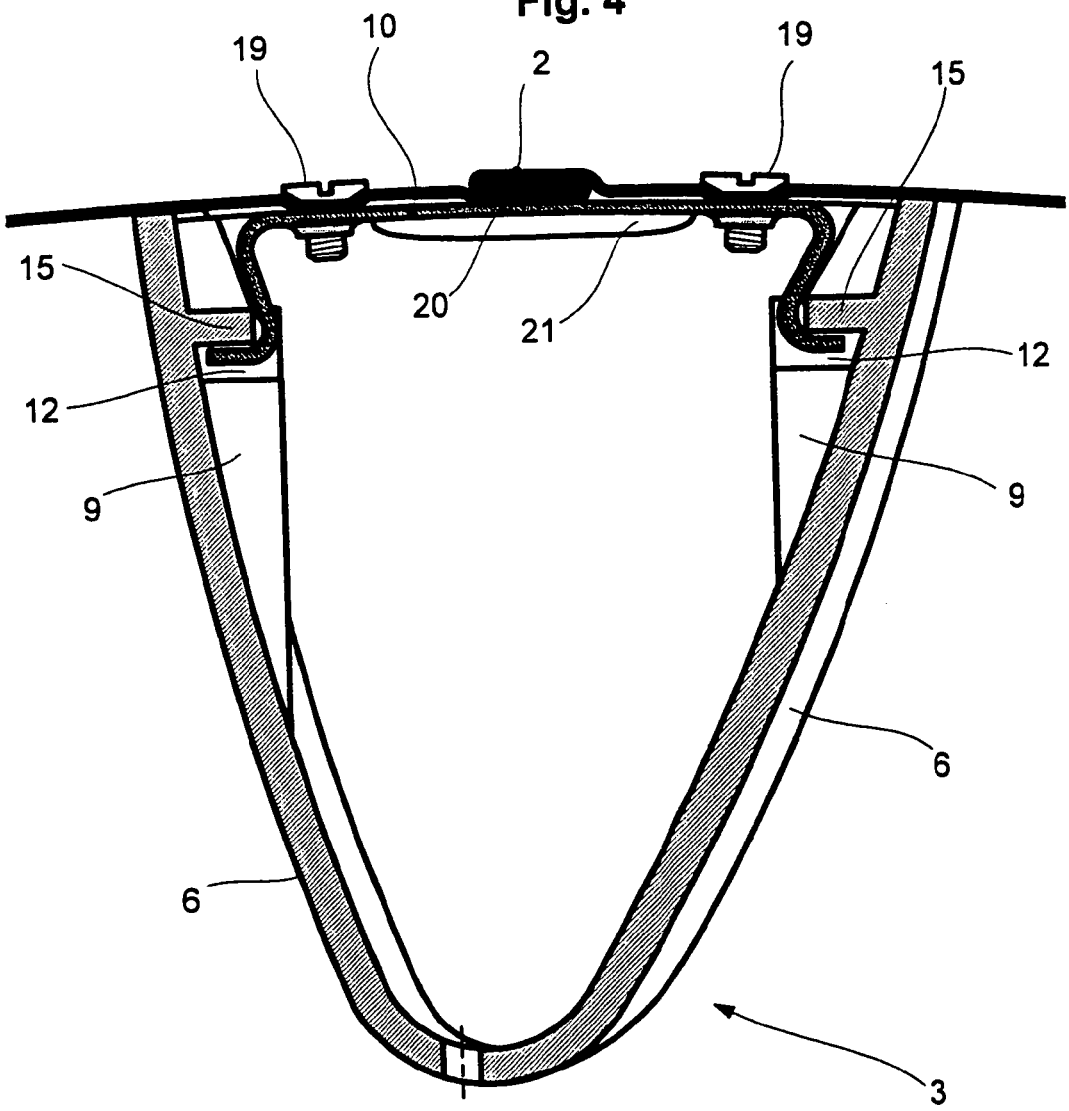
FIG. 4 is a sectional view according to FIG. 3 in the case of a paddle equipped with a flexurally rigid installation part.

The sheet-metal strip 10, immediately alongside each angled end 14, has a threaded bore 18 into which it is possible to screw a screw 19 introduced from the outside of the drum casing 1 (FIGS. 1 and 4). The screw 19 draws the sheet-metal strip 10 tightly against the inside of the drum casing 1 and thus subjects the angled end 14 of the sheet-metal strip 10 to high force. The angled end 14, together with its lug-like end section 13, thus draws the top section 15 of the stiffening structure 9, and thus the paddle 3, tightly against the drum casing 1.

In the case of the paddle 3 illustrated in FIG. 4, the sheet-metal strip 10 is provided, between the threaded bores 18 and the screws 19 passing through them, with a flexurally rigid central section 20 in order to provide particular stiffening in the region of the drum casing 1 against which the central section 20 butts. This is of interest, in particular, for stabilizing the connecting seam 2 of the drum casing 1 which, during spinning, as a result of increased forces in the direction of the casing circumference lines, tends to heave and rupture. This effect would be counteracted primarily by the tension relief of the connecting seam 2 provided by the sheet-metal strip 10, by way of its flexurally rigid central section 20, on the connecting seam 2. As a secondary issue, it is possible to counteract the stabilizing of the connecting seam 2 by the pressure of the sheet-metal strip 10 on the connecting seam 2. For this purpose, the sheet-metal strip 10 may be provided with a bead 21, or be of particularly thick configuration, in the central section 20.

The invention is not restricted to details of the exemplary embodiments illustrated here. In particular, the form-fitting connection between the strip-shaped installation part 10 and the paddle 3 may be illustrated by other forms. For this purpose, it is also conceivable to have configurations in which the angled end 14 is formed in such a manner that the lug-like end section 13 is also bent sideways in respect of the longitudinal extent of the installation part 10 or in the direction of the center of the cavity of the paddle 3. It is possible here for the angled end 14 to be configured with a resilient force that is so high that it is no longer possible for the sheet-metal strip 10, for introduction into the installed position, to be elastically compressed. The undercut 12 may then be configured such that the installation part 10 can be introduced from the side of the undercut 12.

In contrast to the exemplary embodiments, it is also possible for the strip-shaped installation part 10 to achieve the same action without an angled end 14 if its form-fitting fastening in the paddle 3 is brought about in some other way. For example, it is possible for the ends of the strip to be rectilinear if the entire installation part is disposed at a somewhat lower level in the paddle 3, and the fastening elements (e.g. threaded holes) alone are curved further in the direction of the base line of the paddle 3.

It is also possible for the strip-shaped installation part to be configured in a number of parts in order, possibly, to facilitate insertion into the paddle.

It is further possible for the fastening elements to be configured completely differently without departing from the invention. For example, straightforward holes may be provided instead of the threaded holes, and rivets may be provided instead of the screws 19. It is possible here for the rivets to be formed of loose parts or to be an integral component of the strip-shaped installation part 10 or of the drum casing 1. Also conceivable are lugs that are integrally formed on the strip-shaped installation part 10 or on the drum casing 1 and are plugged through through-passages of the same shape, and in the same position, in the respective counterpart (drum casing or strip-shaped installation part) and are bent over behind the same in each case.

I claim:

1. A laundry drum for a drum-type washing machine, the laundry drum comprising:

a drum casing having an outer surface; and at least one paddle fastened on an inside of said drum casing and having a hollow body being open in a direction of said drum casing and a cross-sectional surface area similar to a triangle, said paddle further containing:

first and second flanks defining said hollow body;

stiffening structures disposed on insides of said flanks; and strip-shaped installation parts disposed in a region of at least some of said stiffening structures, said strip-shaped installation parts each spanning from said first flank to said second flank across said hollow body and having a section disposed substantially parallel to said outer surface of said drum casing and connected in a form-fitting manner with said insides of said flanks, said section having at least two fastening elements for fastening said paddle to said drum casing.

2. The laundry drum according to claim 1, wherein:

said stiffening structures have undercuts formed therein; and said strip-shaped installation parts have ends with angled regions angled in a direction of an interior of said paddle and terminate in lug-shaped end sections, said lug-shaped end sections grip beneath said undercuts of said stiffening structures.

3. The laundry drum according to claim 1, wherein said strip-shaped installation parts are rigid in a region between said fastening elements.

4. The laundry drum according to claim 2, wherein regions around said fastening elements and/or said angled regions of said strip-shaped installation parts are of a resilient construction.

5. The laundry drum according to claim 1, wherein a first group of said fastening elements are threaded holes formed in said strip-shaped installation parts and a second group of said fastening elements are screws for connecting said paddle to said drum casing.

6. The laundry drum according to claim 1, wherein a first group of said fastening elements are holes formed in said strip-shaped installation parts and a second group of said fastening elements are rivets for connecting said drum casing to said paddle.

7. The laundry drum according to claim 1, wherein:

said drum casing has holes formed therein; and said fastening elements are disposed on said strip-shaped installation parts as integrally formed rivets which, for connecting said paddle to said drum casing, pass through said holes in said drum casing.

8. The laundry drum according to claim 1, wherein:

said drum casing has slots formed therein; and said fastening elements are disposed on said strip-shaped installation parts as integrally formed lugs which, for connecting said paddle to said drum casing, pass through said slots in said drum casing and are bent over onto said outer surface of said drum casing.

9. The laundry drum according to claim 1, wherein said strip-shaped installation parts are formed from sheet metal.

10. A laundry drum for a drum-type washing machine, the laundry drum comprising:

a drum casing having an outer surface; and at least one paddle fastened on an inside of said drum casing and having a hollow body being open in a direction of said drum casing and a cross-sectional surface area similar to a triangle, said paddle further containing:

flanks;

stiffening structures disposed on insides of said flanks, said stiffening structures have undercuts formed therein; and strip-shaped installation parts disposed in a region of at least some of said stiffening structures, said strip-shaped installation parts each having a section disposed substantially parallel to said outer surface of said drum casing and connected in a form-fitting manner with said insides of said flanks, said section having at least two fastening elements for fastening said paddle to said drum casing, and said strip-shaped installation parts have ends with angled regions angled in a direction of an interior of said Paddle and terminate in lug-shaped end sections, said lug-shaped end sections grip beneath said undercuts of said stiffening structures.

11. A laundry drum for a drum-type washing machine, the laundry drum comprising:

a drum casing having an outer surface; and at least one paddle fastened on an inside of said drum casing and having a hollow body being open in a direction of said drum casing and a cross-sectional surface area similar to a triangle, said paddle further containing:

flanks;

stiffening structures disposed on insides of said flanks, said stiffening structures have undercuts formed therein; and strip-shaped installation parts disposed in a region of at least some of said stiffening structures, said strip-shaped installation parts each having a section disposed substantially parallel to said outer surface of said drum casing and connected in a form-fitting manner with said insides of said flanks, said section having at least two fastening elements for fastening said paddle to said drum casing, and said strip-shaped installation parts have ends with angled regions angled in a direction of an interior of said paddle and terminate in lug-shaped end sections, said lug-shaped end sections grip beneath said undercuts of said stiffening structures, wherein regions around said fastening elements and/or said angled regions of said strip-shaped installation parts are of a resilient construction.

* * * * *